United States Patent [19]

Weir

[11] 4,449,128

[45] May 15, 1984

[54] RADIO FREQUENCY TRANSMITTER COUPLING CIRCUIT

[75] Inventor: Colin B. Weir, Franklin, Mass.

[73] Assignee: GTE Products Corporation, Stamford, Conn.

[21] Appl. No.: 360,877

[22] Filed: Mar. 22, 1982

[51] Int. Cl.[3] ..... H01Q 5/00

[52] U.S. Cl. ..... 343/858; 455/103; 455/129

[58] Field of Search ..... 343/858; 333/1.1, 110, 333/24.1, 24.2, 24.3; 455/277, 129, 103, 101

[56] References Cited

U.S. PATENT DOCUMENTS

| | | | |
|---|---|---|---|
| 3,099,794 | 7/1963 | Essam et al. | 333/24.3 |
| 3,714,661 | 1/1973 | Kershaw | 343/858 |
| 3,928,806 | 12/1975 | Carter et al. | 455/129 |
| 4,206,464 | 6/1980 | Hirsch | 333/1.1 |

*Primary Examiner*—Eli Lieberman
*Assistant Examiner*—Karl Ohralik
*Attorney, Agent, or Firm*—John F. Lawler

[57] ABSTRACT

An efficient circuit for coupling at least three radio frequency transmitters of arbitrary power and frequency to one antenna comprises a three-port circulator connected to the output of each transmitter, a four-port connector and a five-port inphase power combiner, and transmission lines having the same characteristic impedances connecting the circulators through the connector and the combiner to the antenna. The transmission lines interconnecting the components of the circuit have electrical lengths selected to deliver energy in phase to the ports of the connector and to the combiner. In a three-transmitter embodiment, one output port of each circulator is connected to the connector, a second output port of each circulator is connected to the combiner, and the output port of the connector is connected to the combiner. In a four-transmitter embodiment, one output port of each circulator is connected to the connector and the second output port of each circulator is connected to the combiner. In each embodiment, each input to the connector "sees" a 3 to 1 voltage standing wave ratio causing reflected energy to be equally divided and fed in segments of equal power and phase for recombining and feeding the single antenna. The circuit effectively isolates the tansmitters from each other and combines their outputs with high efficiency and minimum loss.

8 Claims, 3 Drawing Figures

RADIO FREQUENCY TRANSMITTER COUPLING CIRCUIT

BACKGROUND OF THE INVENTION

This invention was made under a contract with the Department of the Army.

RELATED APPLICATION

Ser. No. 360,878, filed Mar. 22, 1982.

This invention relates to transmitter-antenna coupling circuits and more particularly to a circuit for coupling a plurality of radio frequency transmitters to a single antenna.

In accordance with prior practice the technique used to combine the outputs of several transmitters without great sacrifice in efficiency was to isolate the transmitters with a frequency selective network such as a diplexer. This has been the practice with TV sound and picture transmitters and in some cases with an additional FM transmitter. Such conventional combining techniques are described in an article entitled "Using Cavities and/or Ferrites in Combiners and Multicouplers," Communications News, June 1977, pages 24–27, inclusive.

An alternate and less desirable approach is to use separate antennas but this usually requires the use of frequency selective filters to isolate the transmitters from each other in order to prevent generation of intermodulation products. In some cases ferrite isolators are used to augment or replace the filters. The obvious disadvantage of this approach is that in many applications there is no room for many isolated antennas.

Less efficient methods use a single large linear amplifier with multiple inputs, or separate transmitters with conventional lossy hybrid combiners. These two methods consume great amounts of power and still generate significant spurious output signals.

The disadvantages of prior techniques are most serious when frequent or rapid frequency change is required of a group of co-located transmitters. In such cases, the filter techniques become impractical. For example, sixteen 40-watt signals using the common linear amplifier approach would require an amplifier with a 10,240 peak watt capability operating Class A. Based on a 26% efficiency single channel design, this would require a continuous input of 39,040 watts. Separate transmitters with conventional power combiners would require 16 transmitters of 1280 watts each for a total of 20,480 watts. Based on a 50% efficiency factor, the total input required would be 40,960 watts.

The coupling circuit embodying this invention combines the transmitter outputs with zero theoretical loss so that in the example above sixteen 40-watt transmitters at 50% efficiency would require 640 watts of RF power and 1280 watts input. In practice of course, components do not have zero loss and actual power requirements are somewhat higher than the theoretical minimum. Results achievable with the practice of the invention, however, represent a substantial improvement over the prior art.

The copending application Ser. No. 360,878 assigned to the assignee of this invention describes a coupler circuit which permits low loss connection of two transmitters to a common antenna. However, accommodation of additional transmitters for connection of one antenna is limited to growth in a binary fashion, i.e., 2, 4, 8, 16, etc. In accordance with this invention, additional flexibility in combining transmitters for this purpose is achieved in other than binary groupings of transmitters.

OBJECTS AND SUMMARY OF THE INVENTION

A general object of the invention is the provision of a circuit for coupling three or more transmitters to a single antenna with greater efficiency than has been achieved in the past.

A further object is the provision of such a circuit which effectively isolates the transmitters from one another.

Still another object is the provision of such a circuit which avoids inherent power sharing loss in the combining process.

These and other objects of the invention are achieved with a coupling circuit which utilizes the nonreciprocal properties of circulators and a four-port tee junction connector providing a deliberate impedance mismatch at the output juncture of three or more transmitters that produces a 3 to 1 VSWR so that reflected energy is equally divided and fed in segments of equal power and phase for recombining and feeding to the single antenna.

DESCRIPTION OF PREFERRED EMBODIMENTS

Figure 1:
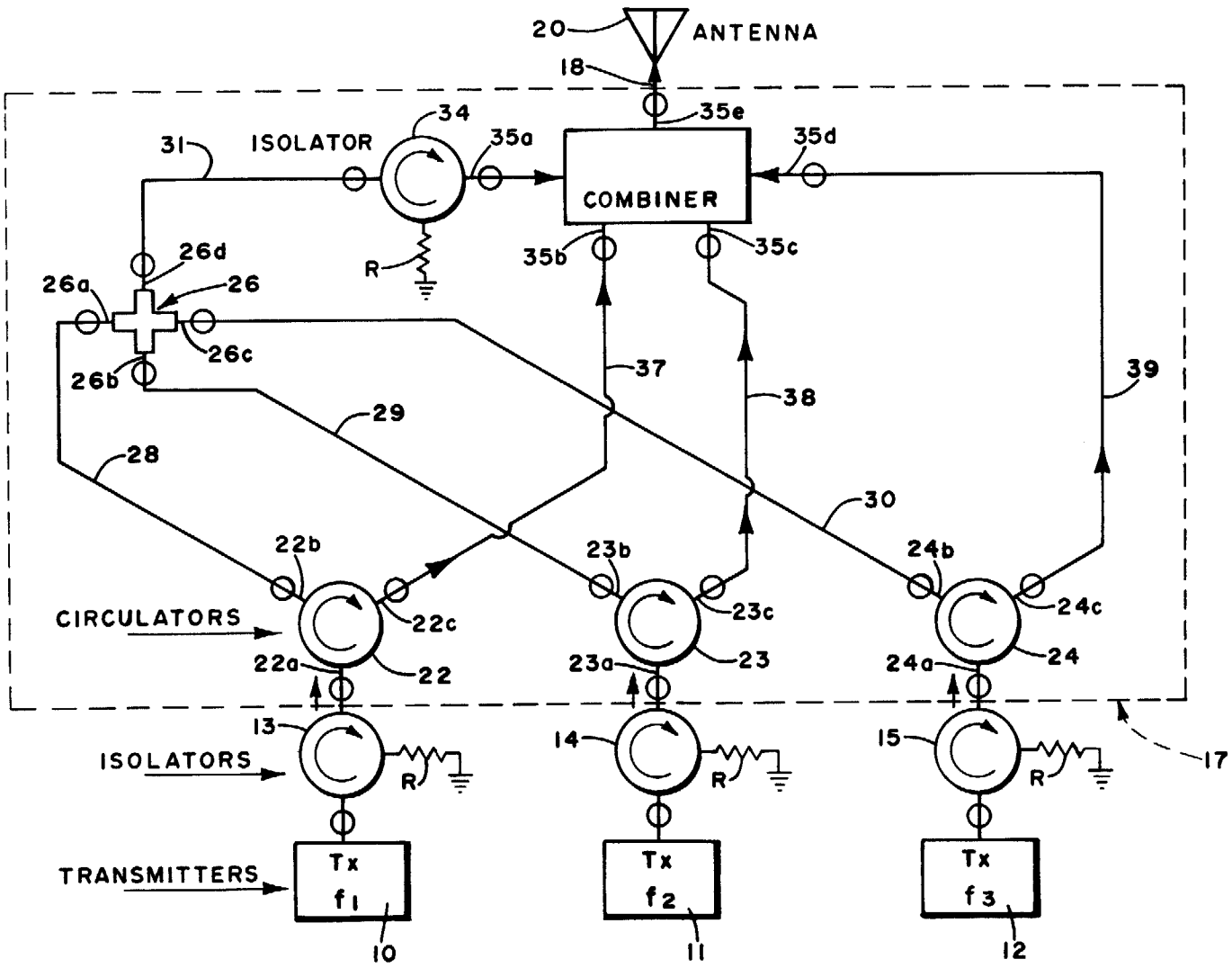
FIG. 1 is a schematic diagram of a circuit embodying this invention used for connecting three transmitters to a common antenna.

Referring now to FIG. 1, transmitters 10, 11 and 12 having frequencies $f_1$, $f_2$ and $f_3$, respectively, are connected through isolators 13, 14 and 15, respectively, to a coupling circuit 17 described below having an output line 18 connected to antenna 20. Each of the isolators 13, 14 and 15 preferably are 3-port circulators having a resistor R connected to one of the ports as shown. Circuit 17 permits any one of the transmitters 10, 11 and 12 to be connected to antenna 20 while maintaining effective isolation between the transmitters and preventing or minimizing creation of intermodulation products.

Circuit 17 comprises identical circulators 22, 23 and 24 having input ports **22*a*, 23*a* and 24*a*, respectively, connected to the outputs of isolators 13, 14 and 15, respectively. The circulators also have output ports 22*b* and 22*c*, 23*b* and 23*c*, and 24*b* and 24*c***, respectively. Adjacent ports of each circulator are nonreciprocally connected to each other in the direction of the arrows.

In order to combine the outputs of the three circulators, a four-way power divider or connector 26 is provided. Connector 26 is a standard component of well known design with four arms intersecting at right angles and has at the outer ends of the respective arms ports **26*a*, 26*b*, 26*c* and 26*d*. By way of example, connector 26 may be Model 17125 manufactured by Amphenol RF Operations of Danbury, Connecticut. Ports 26*a*, 26*b* and 26*c* are connected by transmissions lines 28, 29 and 30, respectively, to the output ports 22*b*, 23*b* and 24*b*, respectively of the circulators and port 26*d* is connected to transmission line 31. Transmission lines 28, 29, 30 and 31** have equal impedances Zo.

In accordance with the invention, power incident on each of ports 26a, 26b and 26c of connector 26 will "see" a 3 to 1 VSWR. The ratio of power reflected to incident power is determined by the following relationship:

$$\frac{Pr}{Pi} = \left(\frac{s-1}{s+1}\right)^2$$

where

Pr = Reflected power

Pi = Incident power s = VSWR

For a 3:1 VSWR, $$\frac{Pr}{Pi} = \left(\frac{3-1}{3+1}\right)^2, \left(\frac{2}{4}\right)^2 = 0.25$$

Thus a 3 to 1 VSWR reflects 25% of the incident power, leaving 75% to travel to the load. The 3 to 1 VSWR is created by the connection of the ports of connector 26 to transmission lines having the same impedance Zo. Assume transmitter 10 is on line sending RF through circulator 22 to connector 26. The impedance presented to line 28 will consist of the impedances of lines 29, 30 and 31 in parallel. Since the impedances of these lines are the same, the impedance seen by line 28 at the connector post 26a is (Zo/3) which corresponds to a 3 to 1 VSWR as described above. Under these circumstances, RF power from transmitter 10 incident on port 26a of connector 26 is divided as follows: 25% is reflected back on line 28 to circulator 22; the remaining 75% is divided equally and flows out the remaining ports of connector 26 of lines 29, 30 and 31 with 25% of the incident power in each line.

Line 31 is connected through an isolator 34 to one input port 35a of a five-port, four-way, in-phase power combiner 35. Combiner 35 has input ports 35b, 35c and 35d connected by transmission lines 37, 38 and 39, respectively, to output ports 22c, 23c and 24c, respectively, of the circulators. Output port 35e of combiner 35 is connected by line 18 to antenna 20. Lines 37, 38 and 39 have the same characteristic impedances Zo as lines 28, 29, 30 and 31. Combiner 35 is a standard component and is sold commercially, for example, by Omni Spectra, Inc. of Merrimac, New Hampshire.

Isolator 34 is needed to decouple connector 26 from any undesired reflections resulting from an excessive VSWR at antenna 20. Any leakage of power from port 22c to port 22a of circulator 22 is prevented from reaching transmitter 10 by isolator 13. Isolators 14 and 15 serve the same function for circulators 23 and 24, respectively.

In order to insure in-phase power delivery to the input ports of combiner 35, the electrical lengths of lines 28, 29 and 30 are equal, lines 37, 38 and 39 have equal electrical lengths, and the electrical length of line 31 is equal to the sum of the electrical lengths of lines 28 and 37 (or lines 29 and 38 or lines 30 and 39).

In operation, assume that transmitter 10 is on line and that transmitters 11 and 12 are not. RF power from transmitter 10 passes through circulator 13 into port 22a of circulator 22 and out port 22b and on line 28 to port 26a of connector 26. This driving transmission line 28 sees an impedance at port 26a which is one-third of its own characteristic impedance causing 25% of the incident power to be reflected back on line 28 to port 22b of circulator 22 and out port 22c through line 37 to port 35b of combiner 35. The remaining 75% of the power at connector 26 is divided evenly and flows out ports 26b, 26c and 26d. The power from ports 26b and 26c similarly is delivered to combiner 35 by lines 29 and 30, respectively, circulators 23 and 24, respectively, and lines 38 and 39, respectively. The power delivered to ports 35a, 35b, 35c and 35d are in-phase because of the line length relationships described above and combiner 35 produces the sum thereof at port 35e for delivery to antenna 20.

Transmitters 11 and 12 similarly independently deliver power through circuit 17 to antenna 20.

Figure 2:
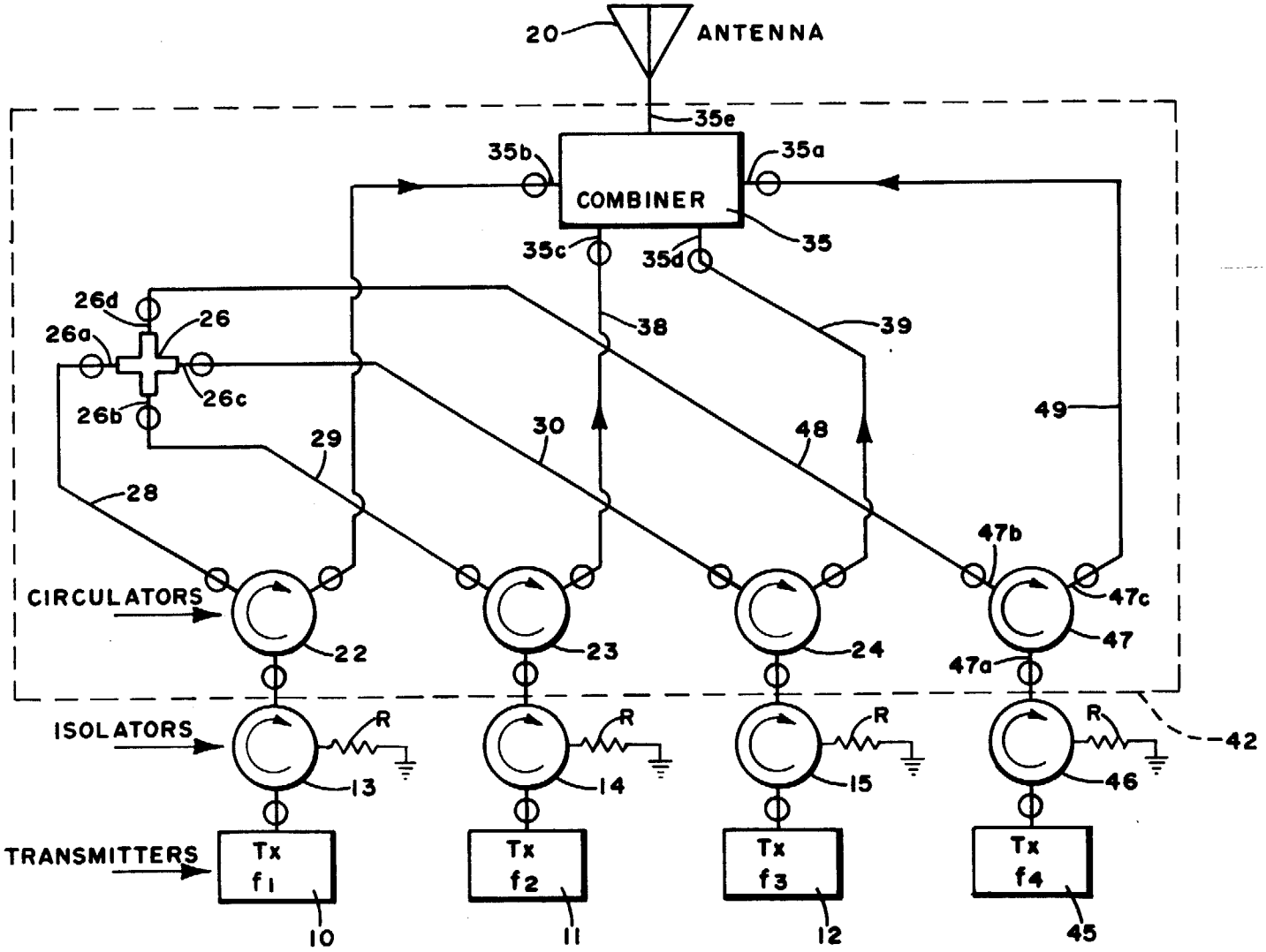
FIG. 2 is a modified form of the coupling circuit used for connecting four transmitters to a common antenna.

With slight modification, the circuit 17 may be readily adapted to connect antenna 20 to the outputs of four transmitters. FIG. 2 shows the modified circuit 42 which is the same in many respects to circuit 17 and therefore like reference characters indicate like components on the drawings. In addition to transmitters 10, 11 and 12, a fourth transmitter 45 is shown connected by isolator 46 to the input port 47a of circulator 47 which has output ports 47b and 47c. Port 26d of connector 26 is connected by line 48 to port 47b of circulator 47 and output port 47c is connected by line 49 to port 35a of combiner 35. Transmission lines 28, 29, 30 and 48 are equal in electrical length, lines 37, 38, 39 and 49 have equal electrical lengths and all of the foregoing lines have the same characteristic impedance Zo. Power from any of the four transmitters is distributed equally and in phase by connector 26 as described above through the four circulators to combiner 35 and to antenna 20.

Figure 3:
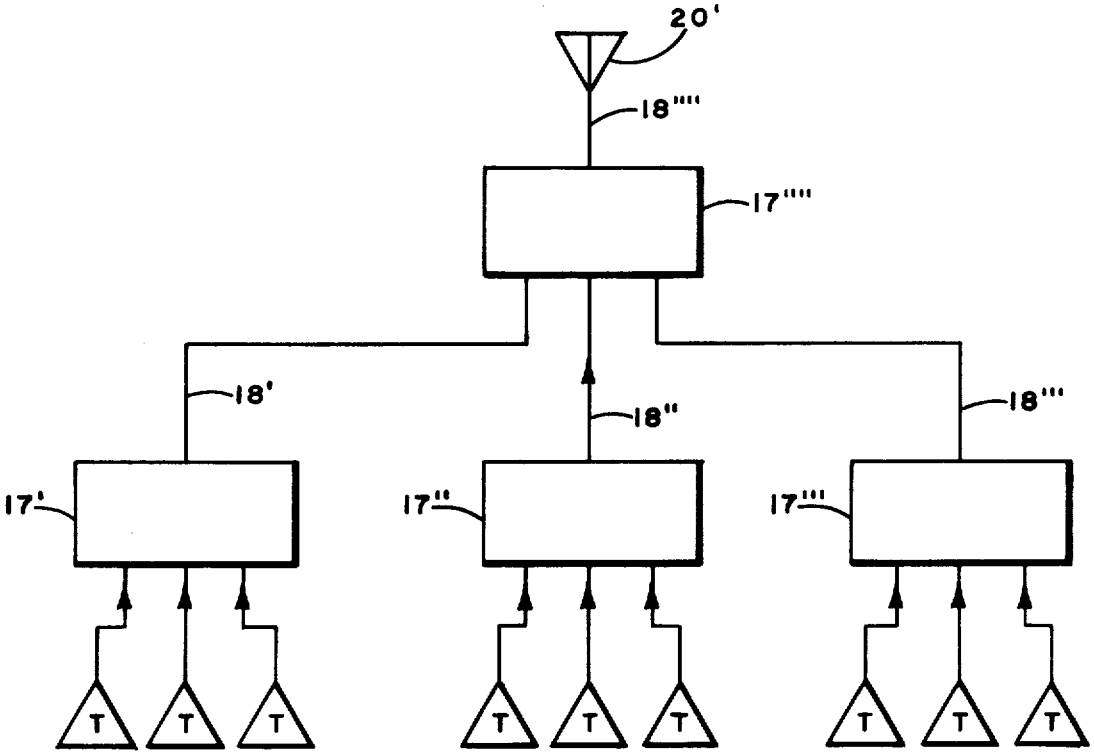
FIG. 3 is a block diagram showing coupling circuits embodying this invention used for connecting nine transmitters to a common antenna.

Since the above described circuits permit three or four transmitters to be connected to a single antenna, three or more of such circuits may be combined into "trees" to provide increased flexibility in combining additional numbers of transmitters to meet operational requirements of single antenna installations. By way of example, a nine-transmitter combining circuit embodying this invention is shown in FIG. 3 and consists of a "tree" comprising three-way coupling circuits 17', 17'' and 17''', each having three transmitters T connected to the input side and each being the same as circuit 17 shown in FIG. 1. The outputs of the three circuits on lines 18', 18'' and 18''', respectively, are fed as inputs to circuit 17'''', also identical to circuit 17, which combines them for a single output connection to antenna 20'. Combinations of the three-way and four-way coupling circuits described above with the two-way coupling circuit of Ser. No. 360,878 provide still more flexibility and utility of the invention.

It is understood that the transmission lines described may be coaxial cable, wave guide, balanced strip line or microstrip.

What is claimed is:

1. A circuit for coupling an antenna to the outputs of at least three transmitters comprising first, second and third circulators, each of said circulators having first, second and third ports with said first and second ports being adjacent and said second and third ports being adjacent, adjacent ports of each circulator being nonreciprocally connected, the first ports of said circulators being connected to said outputs, respectively, of the transmitters, a connector having first, second, third and fourth ports, the impedance at each of said ports of the connector being the same whereby a 3 to 1 voltage standing wave ratio is presented to any one port thereof by the other three ports thereof, a power combiner having first, second, third and fourth input ports and an output port, means for connecting the first port of said connector to the first port of said combiner, means for connecting the second ports of said circulators with equal phase delays to the second, third and fourth ports, respectively, of said connector, and means for connecting the third ports of said circulators with equal phase delays to the second, third and fourth ports, respectively, of said combiner, said output port of said combiner being connected to said antenna.

2. The circuit according to claim 1 with a first transmission line connecting the first port of the connector to the first port of said combiner, second transmission lines connecting the second, third and fourth ports, respectively, of said connector to said second ports, respectively, of the circulators, and third transmission lines connecting the second, third and fourth ports, respectively of said combiner and the third ports, respectively, of said circulators, the characteristic impedances of each of said first, second and third lines being equal.

3. The circuit according to claim 2 in which said second lines have equal lengths and said third lines have equal lengths.

4. A circuit for coupling an antenna to the outputs of at least three transmitters comprising first, second and third circulators, each of said circulators having first, second and third ports with said first and second ports being adjacent and said second and third ports being adjacent, adjacent ports of each circulator being nonreciprocally connected, the first ports of said circulators being connected to said outputs, respectively, of the transmitters, a connector having four ports, the impedances at each of said connector ports being equal whereby a 3 to 1 voltage standing wave ratio exists at three of said ports relative to the fourth port, a power combiner having four input ports and an output port, first means for connecting the second ports of said circulators with equal phase delays to three ports, respectively, of said connector, second means for connecting the third ports of said circulators with equal phase delays to three of said input ports, respectively, of said combiner and, third means connecting the fourth port of said connector to the fourth port of said combiner, the fifth port of said combiner being connected to said antenna.

5. The circuit according to claim 4 in which said first, second and third connecting means comprise transmission lines having equal characteristic impedances.

6. The circuit according to claim 5 in which the lengths of the transmission lines connecting said connector to said circulators are equal and the lengths of the transmission lines connecting said circulators to said combiner are equal.

7. The circuit according to claim 6 in which the length of the transmission line connecting the fourth ports of said connector and said combiner is equal to the sum of the lengths of the transmission lines connecting one of said circulators to said connector and to said combiner, respectively.

8. The circuit according to claim 6 with a fourth transmitter having an output, a fourth circulator identical to each of first named circulators and having first, second and third ports, the first port of said fourth circulator being connected to the output of said fourth transmitter, the second port of said fourth circulator to be connected to said fourth port of said connector, the third port of said fourth circulator being connected to said fourth port of said combiner.

* * * * *